US012405094B1

(12) United States Patent
Xiao

(10) Patent No.: US 12,405,094 B1
(45) Date of Patent: Sep. 2, 2025

(54) DUMMY ROUND

(71) Applicant: Xin'an Xiao, Zhejiang (CN)

(72) Inventor: Xin'an Xiao, Zhejiang (CN)

( * ) Notice: Subject to any disclaimer, the term of this patent is extended or adjusted under 35 U.S.C. 154(b) by 0 days.

(21) Appl. No.: 18/952,158

(22) Filed: Nov. 19, 2024

(51) Int. Cl.
*F42B 8/08* (2006.01)

(52) U.S. Cl.
CPC ..... *F42B 8/08* (2013.01)

(58) Field of Classification Search
CPC ..... F42B 8/08; F41A 17/44
See application file for complete search history.

(56) References Cited

U.S. PATENT DOCUMENTS 407,890 A * 7/1889 Day ..... C10M 169/00 102/511
1,256,255 A * 2/1918 Porter ..... F42B 5/02 73/167
1,347,659 A * 7/1920 Reardon ..... F42B 8/08 124/28
1,997,878 A * 4/1935 Wagner ..... F16L 55/132 220/233
2,342,549 A * 2/1944 Le Gore ..... F42B 8/08 102/498
2,405,308 A * 8/1946 Jack ..... F42B 8/02 73/167
2,530,560 A * 11/1950 Young ..... F41A 17/44 89/31
2,568,080 A * 9/1951 Mcgahey, Jr. ..... F42B 5/36 102/470
2,679,803 A * 6/1954 Lifquist ..... F42B 8/06 102/441
2,882,821 A * 4/1959 Benson ..... F42B 8/08 102/444
3,019,733 A * 2/1962 Braid ..... F42B 8/08 29/521
3,027,840 A * 4/1962 Hannas ..... F42B 8/08 102/444
3,444,639 A * 5/1969 Rockwood ..... F41A 17/44 42/96
3,818,834 A * 6/1974 Baumgartener ..... F42B 8/04 86/37
3,848,350 A * 11/1974 Seminiano ..... F42B 8/08 102/444
4,224,753 A * 9/1980 Bielman ..... F41A 17/44 42/70.11
4,450,769 A * 5/1984 Moser ..... F42B 8/08 102/444

(Continued)

FOREIGN PATENT DOCUMENTS

GB 2138547 A * 10/1984 ..... F42B 8/08

*Primary Examiner* — Derrick R Morgan

(57) ABSTRACT

A dummy round includes a dummy round head and a dummy round case. The dummy round head is a polymer dummy round head. The dummy round case connected to the dummy round head. The dummy round case is a metal dummy round case. Since the dummy round is composed of the polymer dummy round head and the metal dummy round case, a polymer material has relatively low costs and is easy to process and shape. By properly combining the two different materials, the overall dummy round is formed. Compared with a traditional full-plastic or full-metal round, the dummy round has an overall weight closer to that of a real round, and the production costs are reduced.

12 Claims, 6 Drawing Sheets

(56) References Cited

U.S. PATENT DOCUMENTS 5,027,710 A * 7/1991 Wittmann ..... F42B 8/12 102/513
5,097,767 A * 3/1992 Cirillo ..... F42B 10/46 102/517
5,259,319 A * 11/1993 Dravecky ..... F42B 8/10 102/447
5,291,832 A * 3/1994 Plummer ..... F42B 8/08 102/444
5,315,778 A * 5/1994 Wolford ..... F41A 17/44 42/70.11
5,950,344 A * 9/1999 Ross ..... F41A 17/44 42/70.11
6,041,536 A * 3/2000 Samuels ..... F41A 17/44 42/70.11
6,189,454 B1 * 2/2001 Hunt ..... F42B 12/74 102/444
6,250,008 B1 * 6/2001 Silver ..... F41A 17/44 42/70.11
6,305,290 B1 * 10/2001 Stimmell ..... F42B 8/08 102/444
6,443,069 B2 * 9/2002 Proffitt ..... F42B 8/08 42/106
7,752,796 B2 * 7/2010 Ramsey, Sr. ..... F41A 17/44 42/70.11
8,584,587 B2 * 11/2013 Uhr ..... F42B 8/08 102/446
9,222,742 B2 * 12/2015 Steuwer ..... F41A 17/44
10,337,844 B1 * 7/2019 Wall ..... F42B 8/08
11,215,431 B1 * 1/2022 Gould ..... F42B 8/08
11,703,298 B1 * 7/2023 Hsu ..... F41A 17/44 42/96
12,130,123 B2 * 10/2024 Blank ..... B23K 26/362
2001/0007228 A1 * 7/2001 Proffitt ..... F42B 8/08 102/444
2003/0136294 A1 * 7/2003 Guse ..... F42B 8/08 102/444
2011/0214583 A1 * 9/2011 Dutch ..... F42B 5/26 102/464
2014/0096427 A1 * 4/2014 Bonner ..... F42B 8/08 102/444
2017/0138687 A1 * 5/2017 Aziz ..... F41A 17/44
2021/0140747 A1 * 5/2021 McDevitt ..... F42B 33/0207
2023/0228545 A1 * 7/2023 Wilkes ..... F41A 33/00 102/444

* cited by examiner

DUMMY ROUND

TECHNICAL FIELD

The present disclosure relates to the field of dummy rounds, and in particular, to a dummy round.

BACKGROUND

In shooting training, to ensure a consistency between a training effect and an actual combat, a hand feel, weight, and operating mode of a training round usually need to be as close as possible to those of a real round. However, it is often hard to achieve a good balance between cost and weight control and material selection for the traditional training rounds. Plastic training rounds are widely applied to simulated training due to their low costs and easy machining. However, since plastic has a low density, the plastic training round cannot provide a weight close to that of a real round. As a result, the hand feel of use is significantly different from that of the real round, which affects the training effect.

To improve a training experience, the training rounds on the market have started to use materials with higher densities, such as steel, copper, and other metal materials, to increase their weights. However, this often leads to higher production costs, and an excessively high density can cause the weight to exceed a standard round range, thereby affecting the authenticity of training.

SUMMARY

To overcome the shortcomings in the prior art, the present disclosure provides a dummy round. By using a combination of different materials, a weight of a training round is close to a weight of a real round, thus enhancing a hand feel and authenticity during training.

The technical solution adopted by the present disclosure to solve the technical problem is as follows.

A dummy round, includes: a dummy round head and a dummy round case. The dummy round head is a polymer dummy round head; and the dummy round case connected to the dummy round head, wherein the dummy round case is a metal dummy round case.

As an improvement of the present disclosure, the dummy round head is a plastic dummy round head.

As an improvement of the present disclosure, the dummy round case is a low-carbon steel dummy round case.

As an improvement of the present disclosure, the dummy round head is a dummy round head that is in a color of a nontraditional real round head.

As an improvement of the present disclosure, the dummy round head is a blue dummy round head.

As an improvement of the present disclosure, the dummy round case is provided with a front end portion and a rear end portion opposite to the front end portion; and the dummy round head is connected to the front end portion of the dummy round case.

As an improvement of the present disclosure, the dummy round head is in threaded connection to the front end portion of the dummy round case.

As an improvement of the present disclosure, the dummy round head is provided with a connecting end surface connected to the dummy round case; a connecting shaft is arranged on the connecting end surface in a protruding manner; the connecting shaft is provided with an external thread; the dummy round case includes a front end surface arranged at the front end portion; a connecting slot matched with the connecting shaft is provided in the front end surface in an inwards sunken manner; an internal thread is provided on an inner wall of the connecting slot; and the external thread is interlocked with the internal thread to connect and fix the dummy round head to the front end portion of the dummy round case.

As an improvement of the present disclosure, the dummy round case is provided with an identification element, and the identification element is configured for easy identification between the dummy round and a real round.

As an improvement of the present disclosure, the identification element includes an identification groove provided in the dummy round case.

As an improvement of the present disclosure, two identification grooves are provided in a peripheral side wall of the dummy round case and are close to the rear end portion of the round case; and the two identification grooves are oppositely provided in the peripheral side wall of the dummy round case.

As an improvement of the present disclosure, the identification element includes an identification through hole provided in the dummy round case; and the identification through hole is provided in the peripheral side wall of the dummy round case and is close the rear end portion of the dummy round case.

As an improvement of the present disclosure, a protection device is arranged at the rear end portion of the dummy round case; and the protection device is configured to protect a firing pin, which hits a bottom of the dummy round, in a dummy pistol.

As an improvement of the present disclosure, the protection device is a flexible protection device.

As an improvement of the present disclosure, the dummy round case includes a rear end surface arranged at the rear end portion; a mounting slot is provided in the rear end surface in an inwards sunken manner; and the protection device is detachably mounted in the mounting slot.

As an improvement of the present disclosure, the protection device is a rubber pad; and the rubber pad is fixed in the mounting slot by an extrusion force.

As an improvement of the present disclosure, the mounting slot is a cylindrical mounting slot, and the rubber pad is a cylindrical rubber pad.

As an improvement of the present disclosure, a weight of the dummy round head is less than a weight of the dummy round case; a weight range of the dummy round is 3-100 g; a weight range of the dummy round head is 0.5-50 g; and a weight range of the dummy round case is 1-100 g.

As an improvement of the present disclosure, a length range of the dummy round is 15-100 mm; a maximum diameter range of the dummy round is 5-50 mm; a length range of the dummy round head is 3-90 mm; and a length range of the dummy round case is 5-90 mm.

As an improvement of the present disclosure, a length range of the protection device is 0.2-80 mm, and a diameter range of the protection device is 1-50 mm.

The present disclosure has the beneficial effects: The present disclosure provides a dummy round includes a dummy round head and a dummy round case. The dummy round head is a polymer dummy round head. The dummy round case connected to the dummy round head. The dummy round case is a metal dummy round case. Since the dummy round is composed of the polymer dummy round head and the metal dummy round case, a polymer material has relatively low costs and is easy to process and shape. By properly combining the two different materials, the overall dummy round is formed. Compared with a traditional full-plastic or full-metal round, the dummy round has an overall weight closer to that of a real round, and the production costs are reduced.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
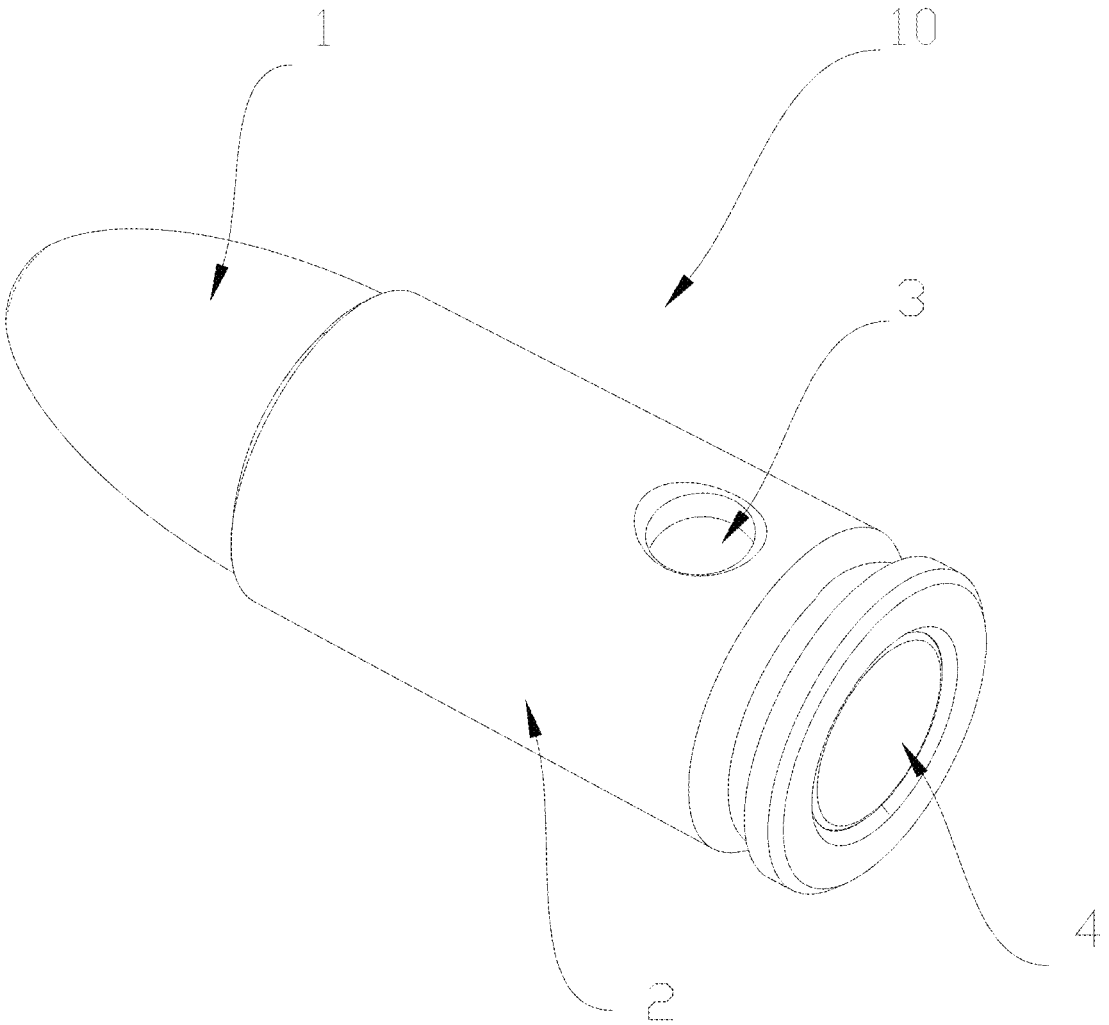
FIG. 1 is a schematic diagram of an entire structure of the present disclosure.
Figure 2:
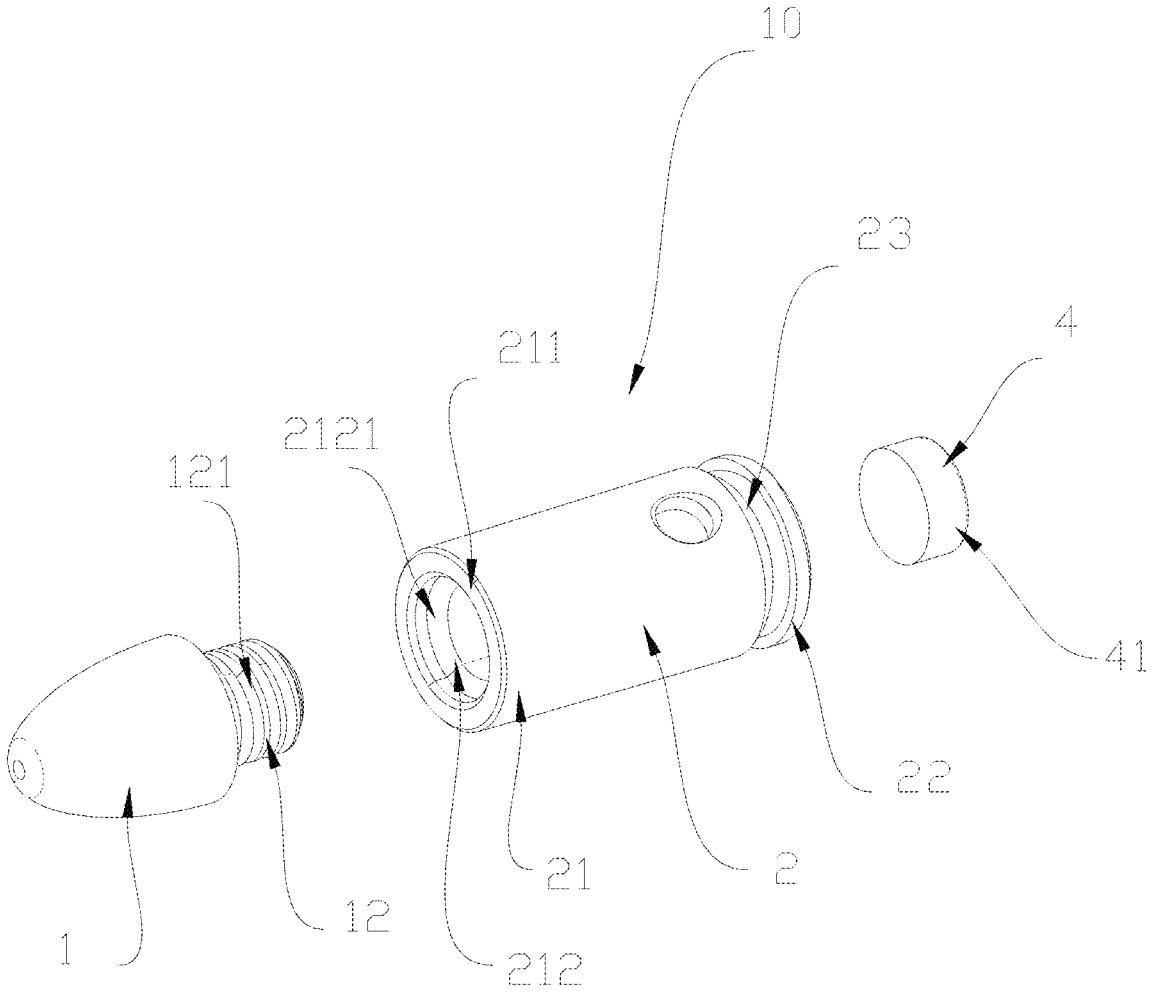
FIG. 2 is an exploded view of the present disclosure.
Figure 3:
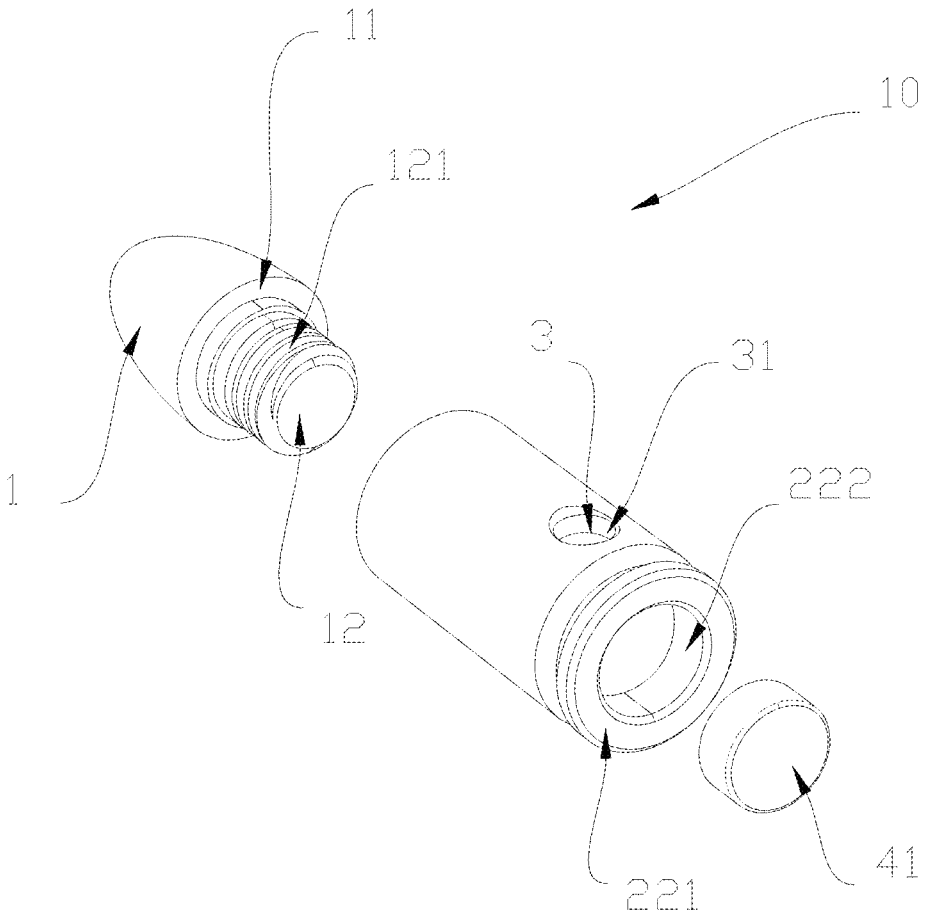
FIG. 3 is another exploded view of the present disclosure.
Figure 4:
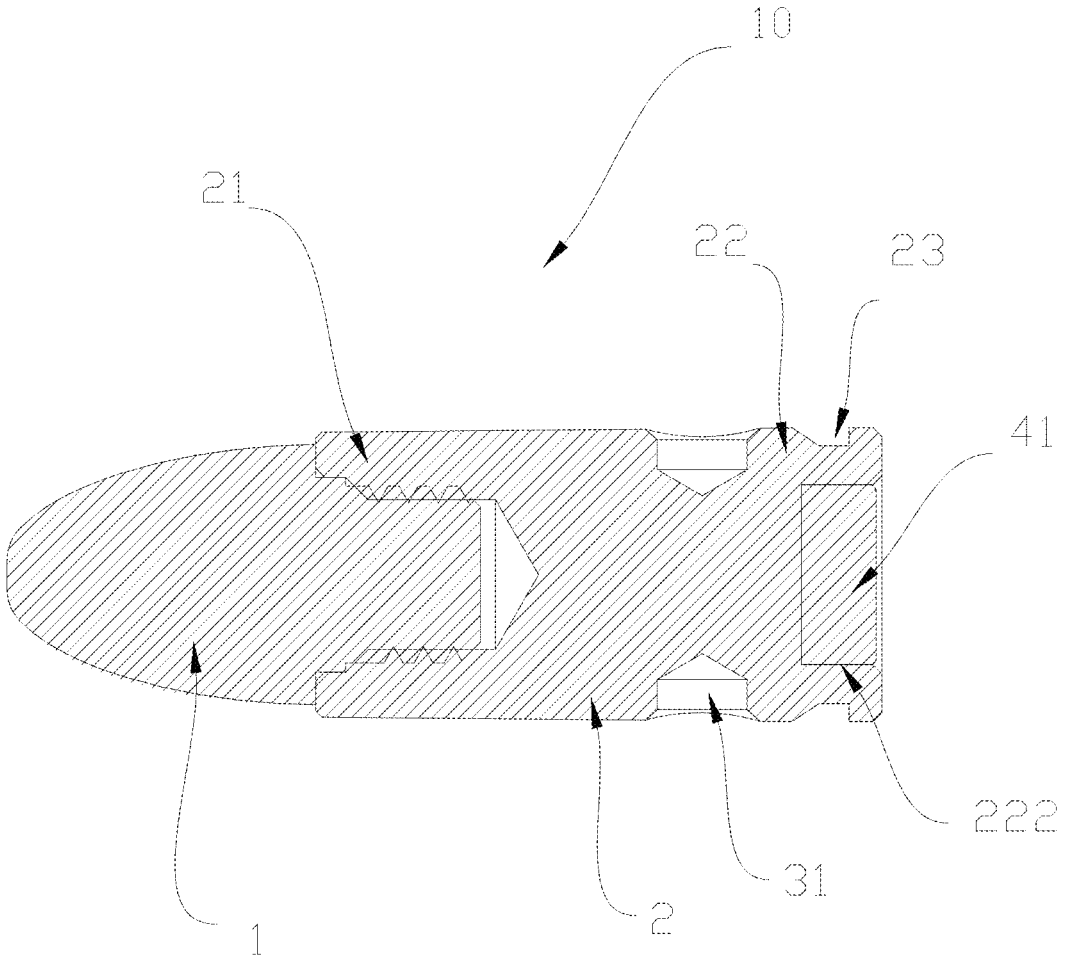
FIG. 4 is a sectional view cut away along a dummy round head and a dummy round case.

Referring to FIG. 1 to FIG. 4, a dummy round 10 includes a dummy round head 1 and a dummy round case 2. The dummy round head 1 is a polymer dummy round head 1; and the dummy round case 2 is connected to the dummy round head 1. The dummy round case 2 is a metal dummy round case 2.

Through the above structure, since the dummy round 10 is composed of the polymer dummy round head 1 and the metal dummy round case 2, a polymer material has relatively low costs and is easy to process and shape. By properly combining the two different materials, the overall dummy round 10 is formed. Compared with a traditional full-plastic or full-metal round, the dummy round has an overall weight closer to that of a real round, and the production costs are reduced.

In this embodiment, the dummy round head 1 is a plastic dummy round head 1. Through the above structure, since the plastic material has low costs, this dummy round is more economical than a metal round. The manufacturing costs of the dummy round can be effectively reduced. The dummy round is suitable for large-batch production and can meet a training need. Furthermore, since the plastic material has a low density, the weight of the dummy round head 1 can be controlled and adjusted through a proper design, so that the weight of the dummy round is closer to the weight of the real round by a matching design of the dummy round head 1 and the dummy round case 2, thereby achieve a better hand feel and enhance the authenticity of training.

In this embodiment, the dummy round case 2 is a low-carbon steel dummy round case 2. Through the above structure, since low-carbon steel has a high density, the weight of dummy round case 2 and the weight of the plastic dummy round head 1 can get close to the weight of the real round, so as to provide a more realistic feel and experience, and enhance the authenticity of training. Furthermore, the dummy round case 2 made of the low-carbon steel material has moderate hardness, which is softer compared with high-carbon steel or other high-hardness metal materials, so that wear on a bolt and a barrel can be effectively reduced.

In this embodiment, the dummy round head 1 is a dummy round head 1 that is in a color of a nontraditional real round head. Specifically, the dummy round head 1 is a blue dummy round head 1. In some other embodiments, the color of the dummy round head 1 includes but is not limited to various bright colors, such as yellow, red, green, purple, and pink, to distinguish the dummy round from the real round.

Through the above structure, the bright color makes the dummy round head 1 more visually prominent, facilitating quick recognition by training personnel, avoiding confusion with the real round, and improving the safety in a training process. Furthermore, during shooting and training, the bright color makes a trajectory of the round head easier to observe, which helps to analyze and calibrate shooting postures and accuracy and improve the training quality.

In this embodiment, the dummy round case 2 is provided with a front end portion 21 and a rear end portion 22 opposite to the front end portion 21; and the dummy round head 1 is connected to the front end portion 21 of the dummy round case 2.

Further, the dummy round head 1 is in threaded connection to the front end portion 21 of the dummy round case 2. Specifically, the dummy round head 1 is provided with a connecting end surface 11 connected to the dummy round case 2; a connecting shaft 12 is arranged on the connecting end surface 11 in a protruding manner; the connecting shaft 12 is provided with an external thread 121; the dummy round case 2 includes a front end surface 211 arranged at the front end portion 21; a connecting slot 212 matched with the connecting shaft 12 is provided in the front end surface 211 in an inwards sunken manner; an internal thread 2121 is provided on an inner wall of the connecting slot 212; and the external thread 121 is interlocked with the internal thread 2121 to connect and fix the dummy round head 1 to the front end portion 21 of the dummy round case 2. Through the above structure and the threaded connection, the dummy round head 1 and the dummy round case 2 can achieve stable mechanical fixation, which effectively prevents looseness caused by vibration or hitting during training, thereby ensuring the overall structural stability of the dummy round 10. In addition, the threaded connection also facilitates quick removal and mounting of the dummy round head 1 and the dummy round case 2, making it convenient for maintenance and replacement during training. If the dummy round head 1 or the dummy round case 2 is damaged, only the corresponding component needs to be replaced, instead of replacing the entire dummy round, thereby reducing the maintenance costs.

In this embodiment, the dummy round case 2 is provided with an identification element 3, and the identification element 3 is configured for easy identification between the dummy round 10 and a real round.

In this embodiment, the identification element 3 includes an identification groove 31 provided in the dummy round case 2. Further, two identification grooves 31 are provided in a peripheral side wall of the dummy round case 2 and are close to the rear end portion 22 of the round case; and the two identification grooves 31 are oppositely provided in the peripheral side wall of the dummy round case 2. Through the above structure, due to the design of the identification grooves 31, a user can quickly distinguish the dummy round 10 from the real round visually or in a tactile manner. Even in a low light environment or during quick operation, the user can accurately distinguish the real round from the training dummy round 10 by touch, thereby lowering the risk of misusing the real round and ensuring the safety of the training process. Furthermore, the identification grooves 31 further play a role in reducing the weight of the dummy round case 2. By increasing or decreasing sizes of the identification grooves 31, the weight of the dummy round 10 can be precisely controlled, making it more perfectly simulate the weight of the real round to enhance the authenticity of training.

Figure 5:
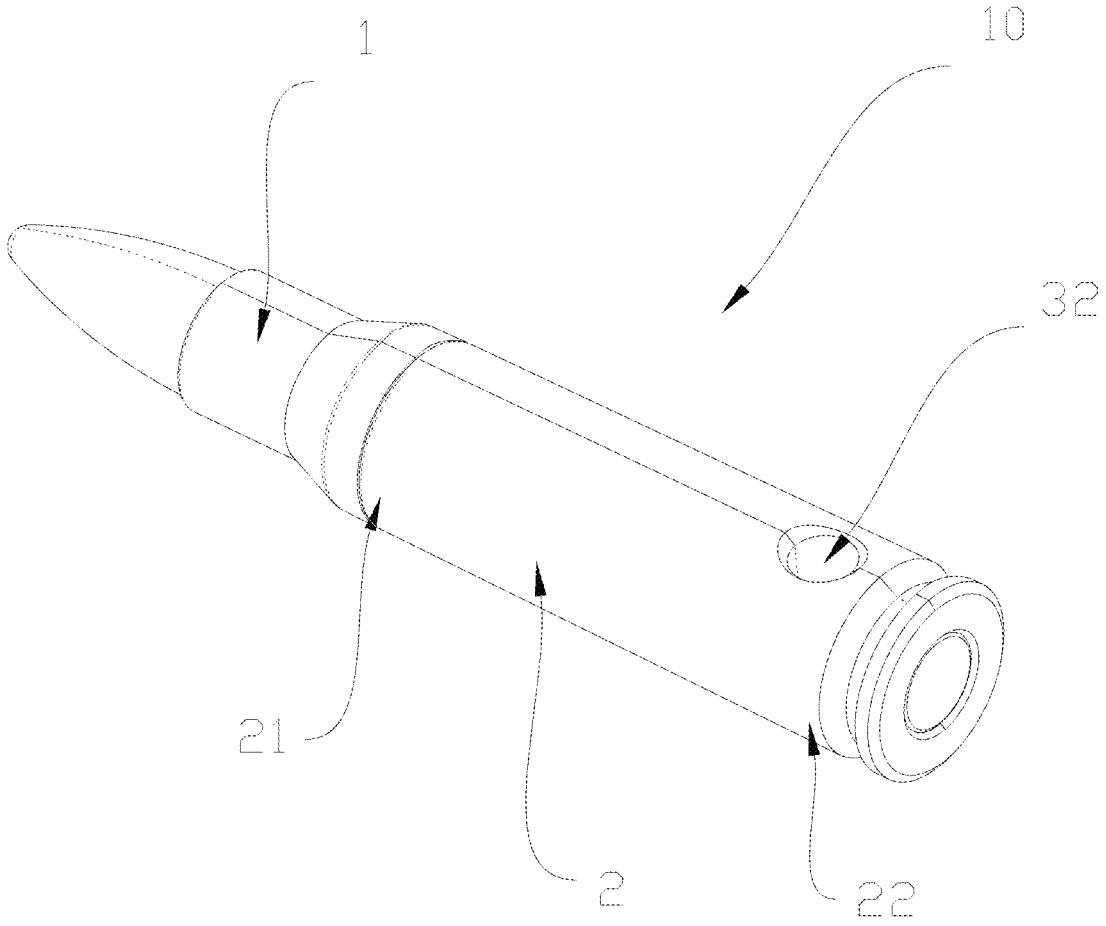
FIG. 5 is a schematic diagram of an entire structure according to another embodiment.
Figure 6:
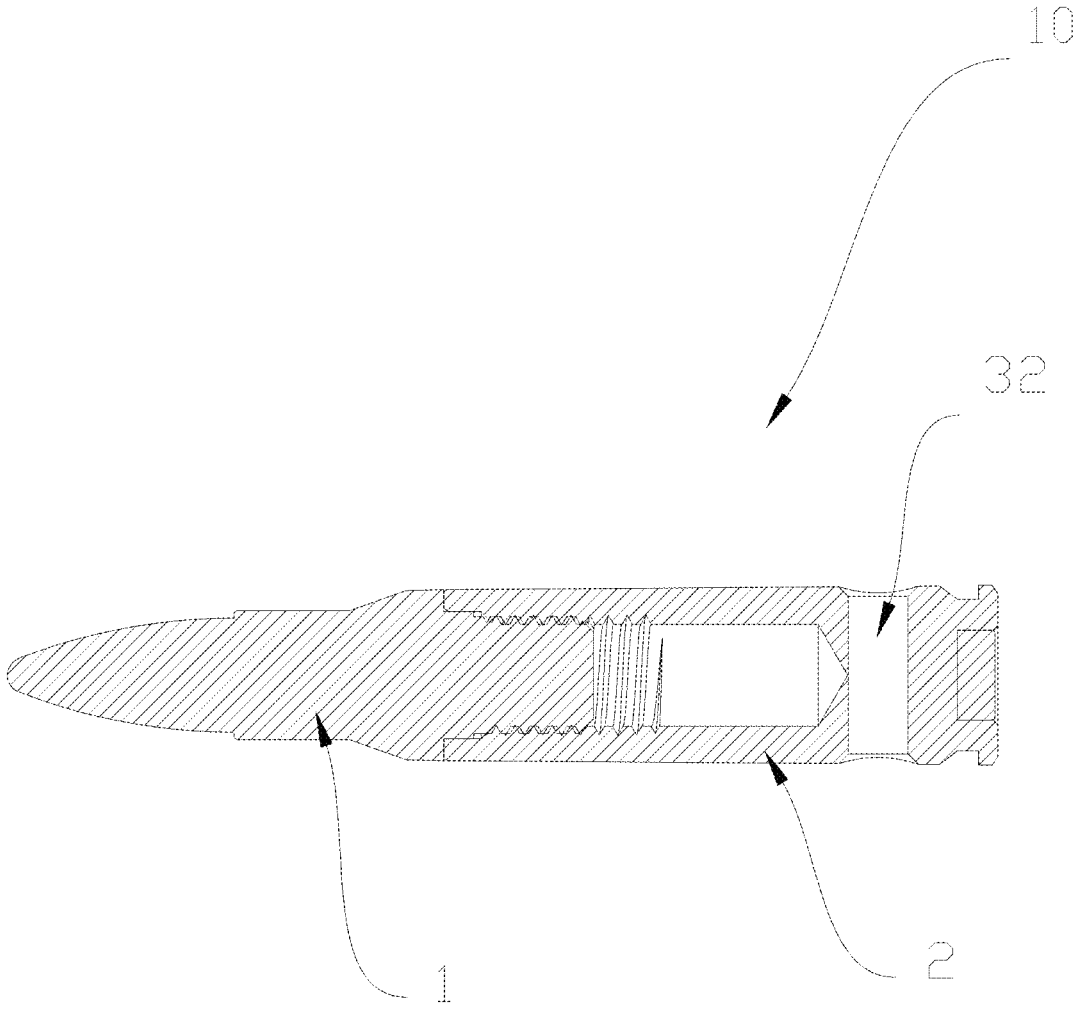
FIG. 6 is a sectional view cut away along a dummy round head and a dummy round case according to another embodiment.

As shown in FIG. 5 to FIG. 6, in another embodiment, the identification element 3 includes an identification through hole 32 provided in the dummy round case 2; and the identification through hole 32 is provided in the peripheral side wall of the dummy round case 2 and is close the rear end portion 22 of the dummy round case 2. Through the above structure, the function of the identification through hole 32 is the same as that of each identification groove 31. The through hole is more convenient to process, thereby reducing processing steps and improving the production efficiency.

In this embodiment, a protection device 4 is arranged at the rear end portion 22 of the dummy round case 2; and the protection device 4 is configured to protect a firing pin, which hits a bottom of the dummy round 10, in a dummy pistol. Specifically, the protection device 4 is a flexible protection device 4. Through the above structure, the flexible protection device 4 is located at the rear end portion 22 of the dummy round case 2, which can effectively buffer the hitting force of the firing pin, avoid direct hard contact, reduce wear and damage to the firing pin, and prolong the service lives of key components of the dummy pistol.

In this embodiment, the dummy round case 2 includes a rear end surface 221 arranged at the rear end portion 22; a mounting slot 222 is provided in the rear end surface 221 in an inwards sunken manner; and the protection device 4 is detachably mounted in the mounting slot 222. Through the above structure, since the protection device 4 is removable, when the protection device 4 is damaged by multiple hits of the firing pin, it is convenient for the user to replace the protection device 4 at any time, thereby reducing the maintenance and replacement costs. There is no need to replace the entire round case or dummy round, so that the costs during long-term use are reduced, and the operating experience of the user is enhanced.

In this embodiment, the protection device 4 is a rubber pad 41; and the rubber pad 41 is fixed in the mounting slot 222 by an extrusion force. Specifically, the mounting slot 222 is a cylindrical mounting slot 222, and the rubber pad 41 is a cylindrical rubber pad 41. Through the above structure, the rubber pad 41, as the protection device 4, has an excellent elasticity and buffering performance, which can effectively absorb the hitting force of the firing pin, reduce a pressure on the firing pin, protect the firing pin from being damaged, and prolong the service life of the dummy pistol. Furthermore, the rubber pad 41 is fixed in the mounting slot 222 by the extrusion force, so that the rubber pad 41 is easily mounted and stable. The user can easily replace the damaged rubber pad 41, thereby improving the maintenance and replacement efficiency and reducing the maintenance costs.

In this embodiment, a weight of the dummy round head 1 is less than a weight of the dummy round case 2; a weight range of the dummy round 10 is 3-100 g; a weight range of the dummy round head 1 is 0.5-50 g; and a weight range of the dummy round case 2 is 1-100 g. Through the above structure, by precisely controlling a ratio of the weight of the dummy round head 1 to the weight of the dummy round case 2, different types of rounds can be better simulated, so that trainees can be trained in a targeted manner on different types of firearms, thereby improving the effectiveness and skillfulness of training.

In this embodiment, a length range of the dummy round 10 is 15-100 mm; a maximum diameter range of the dummy round 10 is 5-50 mm; a length range of the dummy round head 1 is 3-90 mm; and a length range of the dummy round case 2 is 5-90 mm. Through the above structure, due to the settings of these size ranges, the appearance and size of the dummy round 10 are closer to the appearance and size of the real round, which helps trainees adapt to the feeling on real shooting and loading operations.

In this embodiment, a length range of the protection device 4 is 0.2-80 mm, and a diameter range of the protection device 4 is 1-50 mm. Through the above structure, the protection device 4 with a suitable size can ensure effective coverage on a bottom region of the dummy round 10 and good fitness with the dummy round case 2, so that the firing pin is effectively protected from being damaged by frequent hits, thereby prolonging the service life of the firing pin and the service lives of other key components.

In this embodiment, the dummy round head 1 of the dummy round 10 is an approximately hemispherical round head. Through the above structure, the hemispherical dummy round head 1 can simulate a traditional pistol round.

As shown in FIG. 5 to FIG. 6, in another embodiment, the dummy round head 1 of the dummy round 10 is pointed. Through the above structure, the pointed dummy round head 1 can simulate a rifle round.

In this embodiment, a circle of annular slot 23 is provided in the rear end portion 22 of the dummy round case 2. The annular slot 23 is configured to: more firmly fix the dummy round 10 in a barrel of the dummy pistol and pull the training round 10 out of the barrel during ejection of the dummy pistol.

As described above, one or more embodiments are provided in conjunction with the detailed description, The specific implementation of the present disclosure is not confirmed to be limited to that the description is similar to or similar to the method, the structure and the like of the present disclosure, or a plurality of technical deductions or substitutions are made on the premise of the conception of the present disclosure to be regarded as the protection of the present disclosure.

What is claimed is:

1. A dummy round, comprising:

a dummy round head, wherein the dummy round head is a polymer dummy round head; and a dummy round case, connected to the dummy round head, wherein the dummy round case is a metal dummy round case;

wherein the dummy round case is provided with a front end portion and a rear end portion opposite to the front end portion; and the dummy round head is connected to the front end portion of the dummy round case;

wherein the dummy round case is provided with an identification element, and the identification element is configured for easy identification between the dummy round and a real round;

wherein the identification element comprises an identification recess provided in the dummy round case;

wherein two identification recesses are provided in a peripheral side wall of the dummy round case and are close to the rear end portion of the round case; and the two identification recesses are oppositely provided in the peripheral side wall of the dummy round case;

wherein a protection device is arranged at the rear end portion of the dummy round case; and the protection device is configured to protect a firing pin, which hits a bottom of the dummy round, in a dummy pistol;

wherein the protection device is a flexible protection device;

wherein the dummy round case comprises a rear end surface arranged at the rear end portion; a mounting slot is provided in the rear end surface in an inwards sunken manner; and the protection device is detachably mounted in the mounting slot.

2. The dummy round according to claim 1, wherein the dummy round head is a plastic dummy round head.

3. The dummy round according to claim 2, wherein the dummy round case is a low-carbon steel dummy round case.

4. The dummy round according to claim 1, wherein the dummy round head is a dummy round head that is in a color of a nontraditional real round head.

5. The dummy round according to claim 4, wherein the dummy round head is a blue dummy round head.

6. The dummy round according to claim 1, wherein the dummy round head is in threaded connection to the front end portion of the dummy round case.

7. The dummy round according to claim 6, wherein the dummy round head is provided with a connecting end surface connected to the dummy round case; a connecting shaft is arranged on the connecting end surface in a protruding manner; the connecting shaft is provided with an external thread; the dummy round case comprises a front end surface arranged at the front end portion; a connecting slot matched with the connecting shaft is provided in the front end surface in an inwards sunken manner; an internal thread is provided on an inner wall of the connecting slot; and the external thread is interlocked with the internal thread to connect and fix the dummy round head to the front end portion of the dummy round case.

8. The dummy round according to claim 1, wherein the protection device is a rubber pad; and the rubber pad is fixed in the mounting slot by an extrusion force.

9. The dummy round according to claim 8, wherein the mounting slot is a cylindrical mounting slot, and the rubber pad is a cylindrical rubber pad.

10. The dummy round according to claim 1, wherein a weight of the dummy round head is less than a weight of the dummy round case; a weight range of the dummy round is 3-100 g; a weight range of the dummy round head is 0.5-50 g; and a weight range of the dummy round case is 1-100 g.

11. The dummy round according to claim 1, wherein a length range of the dummy round is 15-100 mm; a maximum diameter range of the dummy round is 5-50 mm; a length range of the dummy round head is 3-90 mm; and a length range of the dummy round case is 5-90 mm.

12. The dummy round according to claim 1, wherein a length range of the protection device is 0.2-80 mm, and a diameter range of the protection device is 1-50 mm.

* * * * *